US011756721B2

(12) United States Patent
Morita et al.

(10) Patent No.: US 11,756,721 B2
(45) Date of Patent: Sep. 12, 2023

(54) PLANAR TRANSFORMER

(71) Applicant: IBIDEN CO., LTD., Ogaki (JP)

(72) Inventors: Haruhiko Morita, Ogaki (JP); Hitoshi Miwa, Ogaki (JP); Shinobu Kato, Ogaki (JP); Toshihiko Yokomaku, Ibi-gun (JP); Hisashi Kato, Ogaki (JP); Takahisa Hirasawa, Ogaki (JP); Tetsuya Muraki, Ogaki (JP); Takayuki Furuno, Ogaki (JP)

(73) Assignee: IBIDEN CO., LTD., Ogaki (JP)

( * ) Notice: Subject to any disclaimer, the term of this patent is extended or adjusted under 35 U.S.C. 154(b) by 566 days.

(21) Appl. No.: 16/804,047

(22) Filed: Feb. 28, 2020

(65) Prior Publication Data

US 2020/0286678 A1 Sep. 10, 2020

(30) Foreign Application Priority Data

Mar. 8, 2019 (JP) ..... 2019-042659

(51) Int. Cl.
*H01F 27/28* (2006.01)
*H01F 27/29* (2006.01)
*H01F 27/06* (2006.01)

(52) U.S. Cl.
CPC ..... *H01F 27/29* (2013.01); *H01F 27/06* (2013.01); *H01F 27/2804* (2013.01); *H01F 2027/065* (2013.01); *H01F 2027/2809* (2013.01); *H01F 2027/2819* (2013.01)

(58) Field of Classification Search
CPC ..... H01F 27/2804; H01F 2027/2809; H01F 17/0013; H01F 17/0006; H01F 5/003; H01F 2027/2819; H01F 2027/2861; H01F 27/29; H01F 27/292; H01F 27/24; H01F 27/06; H01F 2027/065; H01F 2017/006
USPC ..... 336/200, 232
See application file for complete search history.

(56) References Cited

U.S. PATENT DOCUMENTS 2,911,605 A * 11/1959 Wales, Jr. ..... H01F 17/0006 439/85
4,517,540 A * 5/1985 McDougal ..... F16L 37/53 336/107
5,276,421 A * 1/1994 Boitard ..... H01F 27/2804 336/200

FOREIGN PATENT DOCUMENTS

JP 61134003 A * 6/1986 ..... H01F 27/2804
JP 2000-340445 A 12/2000

* cited by examiner

*Primary Examiner* — Tszfung J Chan
(74) *Attorney, Agent, or Firm* — Oblon, McClelland, Maier & Neustadt, L.L.P.

(57) ABSTRACT

A planar transformer includes a coil substrate including a flexible substrate and multiple coils formed on the flexible substrate. The coil substrate is formed to have coil parts and coilless parts such that the coil parts have the coils and that the coilless parts do not have the coils, and the coil substrate is folded such that at least one of the coilless parts is sandwiched between two of the coil parts.

20 Claims, 8 Drawing Sheets

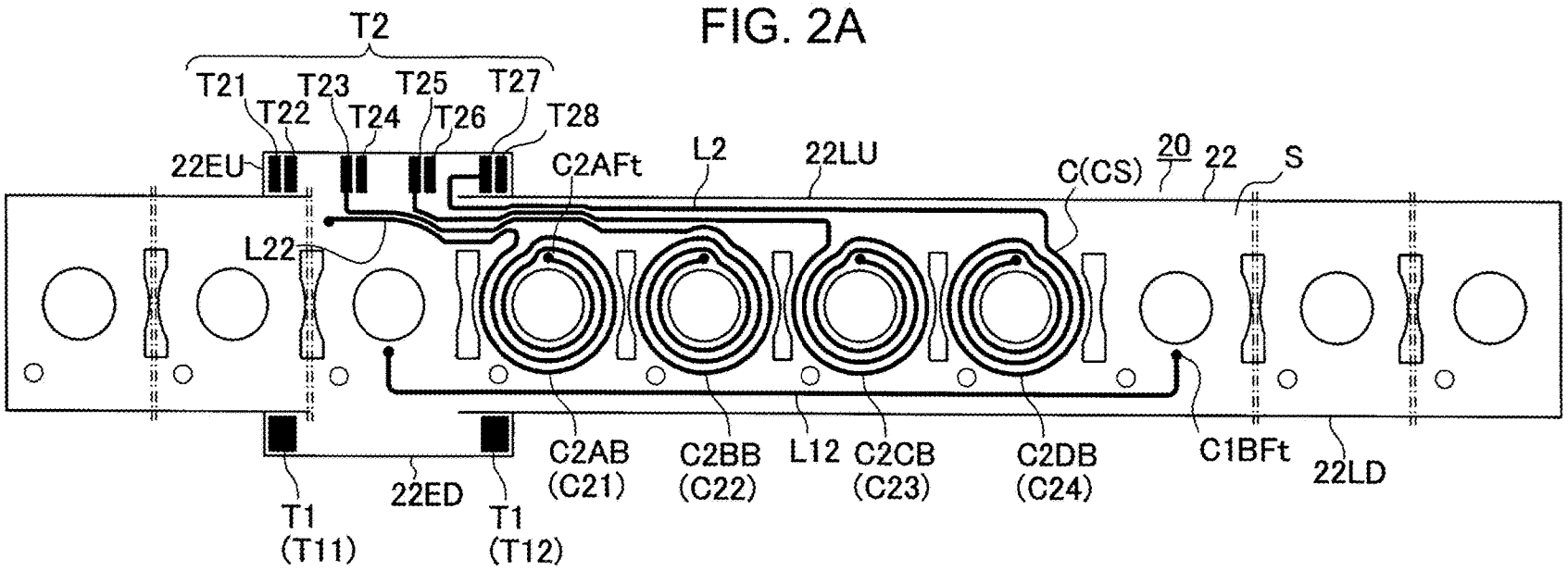
FIG. 2A
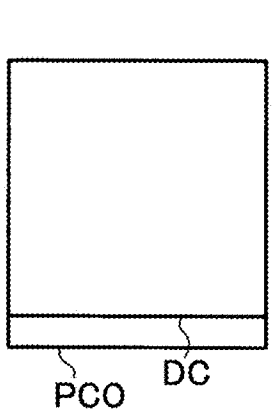
FIG. 2B
FIG. 2C
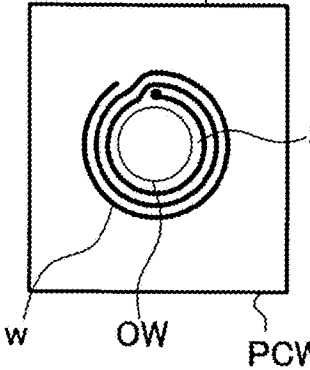
FIG. 2D
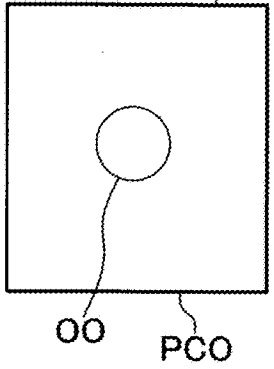
FIG. 2E

PLANAR TRANSFORMER

CROSS-REFERENCE TO RELATED APPLICATIONS

The present application is based upon and claims the benefit of priority to Japanese Patent Application No. 2019-042659, filed Mar. 8, 2019, the entire contents of which are incorporated herein by reference.

BACKGROUND OF THE INVENTION

Field of the Invention

The present invention relates to a planar transformer formed by folding a coil substrate that includes a flexible substrate and coils on the flexible substrate.

Description of Background Art

Japanese Patent Application Laid-Open Publication No. 2000-340445 describes a method for manufacturing a planar transformer. The manufacturing method of Japanese Patent Application Laid-Open Publication No. 2000-340445 includes stacking multiple green tapes. The entire contents of this publication are incorporated herein by reference.

SUMMARY OF THE INVENTION

According to one aspect of the present invention, a planar transformer includes a coil substrate including a flexible substrate and multiple coils formed on the flexible substrate. The coil substrate is formed to have coil parts and coilless parts such that the coil parts have the coils and that the coilless parts do not have the coils, and the coil substrate is folded such that at least one of the coilless parts is sandwiched between two of the coil parts.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2A illustrates a second surface of the coil substrate of the first embodiment;

FIGS. 2B, 2C and 2E each illustrate a coilless part;

FIG. 2D illustrates a coil part;

DETAILED DESCRIPTION OF THE EMBODIMENTS

Figure 1A:
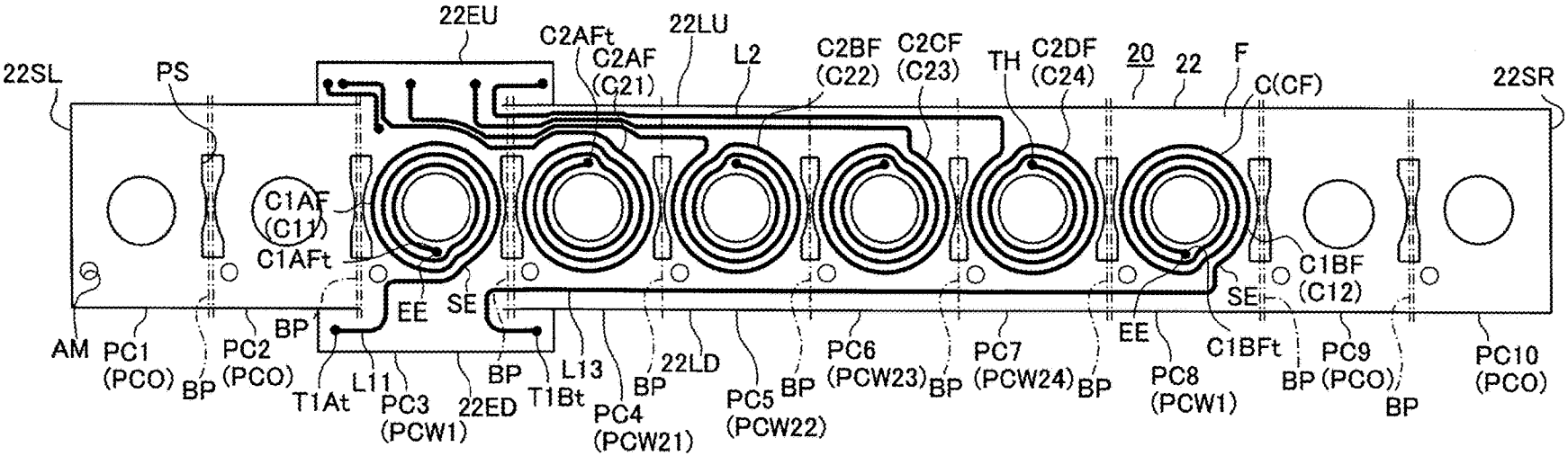
FIG. 1A illustrates a first surface of a coil substrate according to a first embodiment of the present invention.

Embodiments will now be described with reference to the accompanying drawings, wherein like reference numerals designate corresponding or identical elements throughout the various drawings.

Embodiment

Figure 4A:
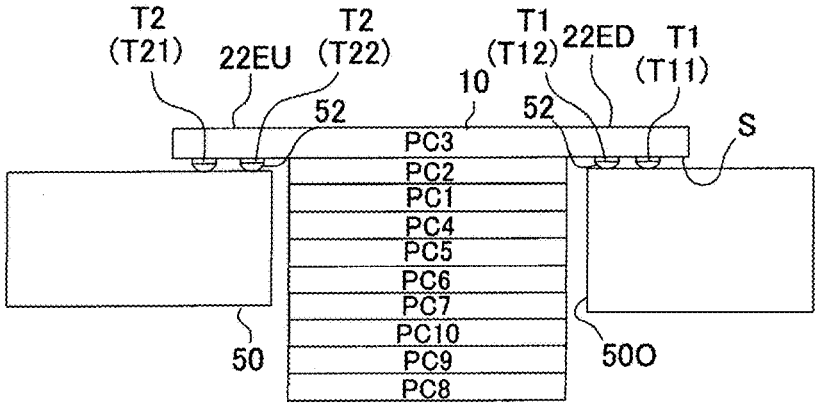
FIG. 4A illustrates a cross section of a printed wiring board and a planar transformer mounted on the printed wiring board.

FIG. 4A schematically illustrates a cross section of a planar transformer 10 of an embodiment.

The planar transformer 10 has input terminals (T1) and output terminals (T2). The input terminals (T1) and the output terminals (T2) of the planar transformer 10 are connected to a printed wiring board 50 via solders 52. The input terminals (T1) include a first input terminal (T11) and a second input terminal (T12). The output terminals (T2) include a first output terminal (T21) and a second output terminal (T22). Electronic components can be mounted on the printed wiring board 50. The number of electronic components to be mounted is one or more.

Figure 5A:
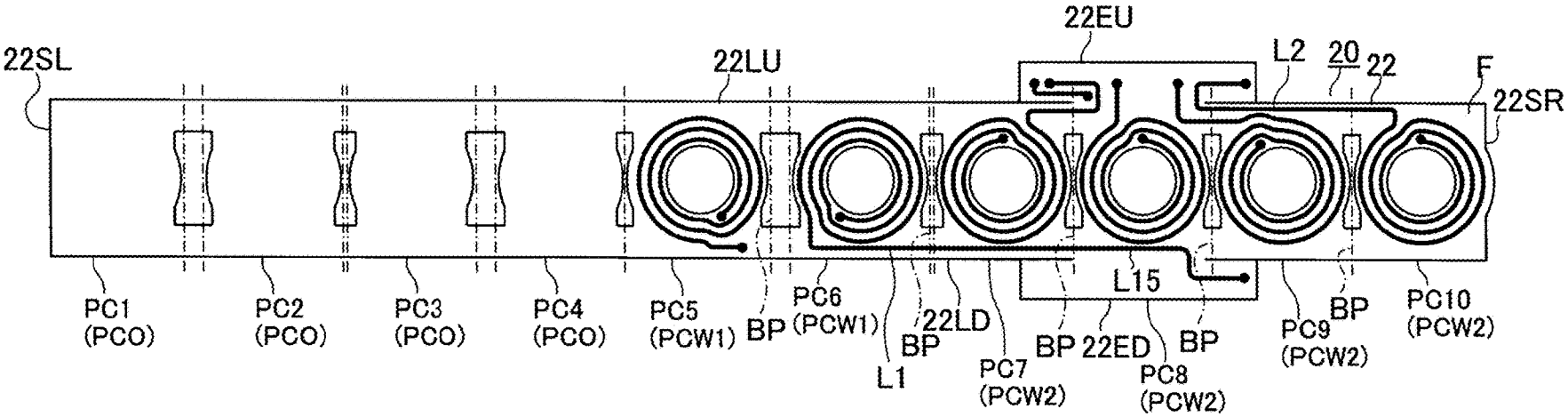
FIG. 5A illustrates a first surface of a coil substrate for manufacturing a planar transformer of a second embodiment.
Figure 5B:
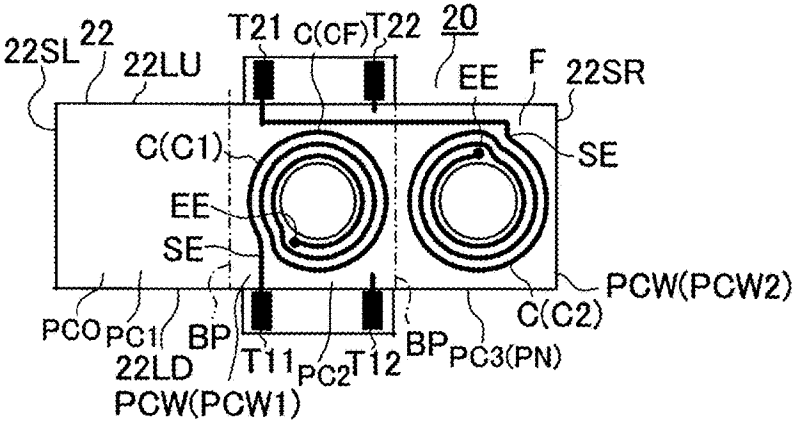
FIG. 5B illustrates a first surface of a coil substrate for manufacturing a planar transformer of an embodiment.

FIG. 5B illustrates a coil substrate 20 for manufacturing the planar transformer 10 of the embodiment. The planar transformer 10 is manufactured by folding the coil substrate 20. The coil substrate 20 is folded along folding parts (BP).

As illustrated in FIG. 5B, the coil substrate 20 is formed to include a flexible substrate 22 and multiple coils (C), the flexible substrate 22 having a first surface (F) and a second surface (S) on an opposite side with respect to the first surface (F), and the multiple coils (C) being formed on the first surface (F) of the flexible substrate 22. FIG. 5B illustrates the first surface (F) of the flexible substrate.

The flexible substrate 22 has a one-end (22SL) and an other-end (22SR) on an opposite side with respect to the one-end (22SL). Further, the flexible substrate 22 has an upper side (22LU) and a lower side (22LD) on an opposite side with respect to the upper side (22LU). The upper side (22LU) and the lower side (22LD) are formed between the one-end (22SL) and the other-end (22SR).

A coil (C) on the first surface (F) of the flexible substrate 22 is referred to as an upper coil (CF).

Figure 1B:
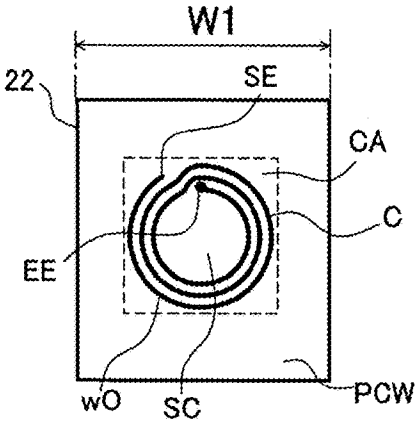
FIG. 1B illustrates a coil part.
Figure 1C:
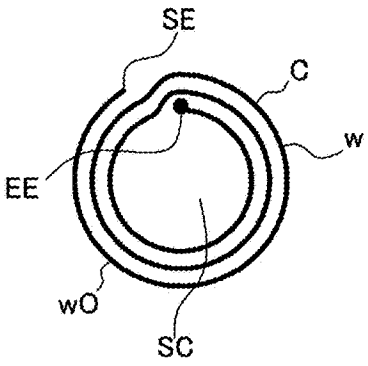
FIG. 1C illustrates a coil.

As illustrated in FIG. 1C, a coil (C) is formed by a wiring (w) extending from a starting end (SE) to an ending end (EE). The starting end (SE) is an outermost portion of the wiring (w), and the ending end (EE) is an innermost portion of the wiring (w). The wiring (w) forming a coil (C) is formed around a central space (SC). Further, the wiring (w) is formed in a spiral shape.

As illustrated in FIG. 5B, the coils (C) include a primary coil (C1) and a secondary coil (C2).

The primary coil (C1) is formed between the first input terminal (T11) and the second input terminal (T12). For example, the first input terminal (T11) is connected to the starting end (SE) of the primary coil (C1), and the second input terminal (T12) is connected to the ending end (EE) of the primary coil (C1). The connection between the ending end (EE) and the second input terminal (T12) is omitted in the illustration. Then, a predetermined voltage (first voltage) is applied between the first input terminal (T11) and the second input terminal (T12).

The secondary coil (C2) is formed between the first output terminal (T21) and the second output terminal (T22). For example, the first output terminal (T21) is connected to the starting end (SE) of the secondary coil (C2), and the second output terminal (T22) is connected to the ending end (EE) of the secondary coil (C2). The connection between the ending end (EE) and the second output terminal (T22) is omitted in the illustration.

A magnetic field is generated by applying a current to the primary coil (C1) in the planar transformer 10. The voltage applied between the first input terminal (T11) and the second input terminal (T12) is the first voltage. A current flows in the secondary coil (C2) due to electromagnetic induction caused by applying a current to the primary coil (C1). A predetermined voltage (second voltage) is generated between the first output terminal (T21) and the second output terminal (T22).

The secondary coil (C2) formed between the first output terminal (T21) and the second output terminal (T22) can be referred to as a first secondary coil (C21).

The coil substrate 20 can further have a second secondary coil (C22), a third output terminal (T23), and a fourth output terminal (T24). For example, the third output terminal (T23) is connected to the starting end (SE) of the second secondary coil (C22), and the fourth output terminal (T24) is connected to the ending end (EE) of the second secondary coil (C22). The first secondary coil (C21) and the second secondary coil (C22) are independent of each other. The two are not electrically connected to each other. Then, a magnetic field is generated by applying a current to the primary coil (C1) in the planar transformer 10. A current flows in the second secondary coil (C22) due to the magnetic field. A predetermined voltage (third voltage) is generated between the third output terminal (T23) and the fourth output terminal (T24).

The coil substrate 20 can further have a third secondary coil (C23), a fifth output terminal (T25), and a sixth output terminal (T26). For example, the fifth output terminal (T25) is connected to the starting end (SE) of the third secondary coil (C23), and the sixth output terminal (T26) is connected to the ending end (EE) of the third secondary coil (C23). The first secondary coil (C21), the second secondary coil (C22) and the third secondary coil (C23) are independent of each other. These coils are not electrically connected to each other. Then, a magnetic field is generated by applying a current to the primary coil (C1) in the planar transformer 10. A current flows in the third secondary coil (C23) due to the magnetic field. A predetermined voltage (fourth voltage) is generated between the fifth output terminal (T25) and the sixth output terminal (T26).

For example, by changing the number of turns of a secondary coil (C2), the magnitude of a current induced in the secondary coil (C2) can be changed. A voltage applied to the secondary coil (C2) changes.

For example, by changing the number of turns of the primary coil (C1), the magnitude of a current induced in a secondary coil (C2) can be changed. A voltage applied to the secondary coil (C2) changes.

For example, the number of the output terminals (T2) depends on the number of voltages generated by the secondary coils (C2). The number (PWN) of the voltages generated by the secondary coils (C2) and the number (T2N) of the output terminals (T2) satisfy the following Relation 1.

$$T2N=2\times PWN \qquad \text{Relation 1:}$$

For example, the number of the output terminals (T2) depends on the number of types of the secondary coils (C2). The number (KN) of the types of the secondary coils (C2) and the number (T2N) of the output terminals (T2) satisfy the following Relation 2.

$$T2N=2\times KN \qquad \text{Relation 2:}$$

Different types of secondary coils (C2) generate different voltages.

For example, the magnitude of the first voltage, the magnitude of the second voltage, the magnitude of the third voltage, and the magnitude of the fourth voltage are different from each other. Various voltages can be output by applying a voltage between the input terminals (T11, T12) of the planar transformer 10.

The voltages between the secondary coils may be the same. In that case, the second voltage, the third voltage, and the fourth voltage are equal to each other.

The coil substrate 20 is formed of the one flexible substrate 22. Then, the one flexible substrate 22 is divided into multiple portions (PF). Therefore, the coil substrate 20 is also divided into multiple portions (PC). The coil substrate 20 is formed of the multiple portions (PC). Adjacent portions (PF, PC) are directly connected to each other. The portions (PF, PC) are arranged in one row from the one-end (22SL) to the other-end (22SR). The number of the portions (PF, PC) is N. The (m+1)-th portion is arranged next to the m-th portion. That is, the portion including the one-end (22SL) is the first portion (P1). Next to the first portion (P1) is the second portion (P2). Next to the second portion (P2) is the third portion (P3). The portion including the other-end (22SR) is the N-th portion (PN). m and N are natural numbers.

The portions (PC) forming the coil substrate 20 include portions (coil parts) (PCW) that each have a coil (C) and portions (coilless parts) (PCO) that do not each have a coil (C).

A coil part (PCW) having a primary coil (C1) is a primary coil part (PCW1), and a coil part (PCW) having a secondary coil (C2) is a secondary coil part (PCW2). A schematic diagram of a primary coil part (PCW1) or a secondary coil part (PCW2) is illustrated in FIG. 1B. FIG. 1B illustrates a flexible substrate 22 that forms a coil part (PCW), and a coil (C) on the flexible substrate 22. As illustrated in FIG. 1B, the coil (C) is positioned substantially at a center of the coil part (PCW). The coil (C) is formed inside a formation region (CA). The formation region (CA) has a rectangular shape. Further, the four sides of the formation region (CA) are in contact with an outermost wiring (wO) forming the coil (C). The outermost wiring (wO) is illustrated in FIGS. 1B and 1C.

Examples of coilless parts (PCO) are illustrated in FIGS. 2B and 2C. FIG. 2B illustrates a flexible substrate 22 that forms a coilless part (PCO). In the example in FIG. 2B, the flexible substrate is completely exposed. That is, the first surface (F) and the second surface (S) are completely exposed.

In the example of FIG. 2C, the flexible substrate is partially exposed. That is, the coilless part (PCO) illustrated in FIG. 2C does not have a coil (C), but has a conductor circuit (DC) other than a coil (C). Examples of conductor circuits (DC) include input lines (L1), output lines (L2), connection wirings (cL) connecting between coils (C). For example, an input line (L1) is a conductor circuit (DC) connecting an input terminal (T1) to a primary coil (C1), and an output line (L2) is a conductor circuit (DC) connecting an output terminal (T2) to a secondary coil (C2).

The number of the coilless parts (PCO) is preferably an even number. The coilless part (PCO) of FIG. 2B does not have a wiring (w) that forms a coil, and does not have a conductor circuit (DC).

The planar transformer 10 of the embodiment is formed by folding the coil substrate 20. For example, the coil substrate 20 is folded between the m-th portion (PCm) and the (m+1)-th portion (PCm1). Therefore, a coil (C) in one coil part (PCW) can be stacked on a coil (C) in another coil part (PCW) with high positional accuracy. A magnetic field is generated by applying a current to a coil (C) in one coil part (PCW). Then, a current is induced in a coil (C) in another coil part (PCW) due to the magnetic field. According to the embodiment, efficiency of electromagnetic induction can be increased.

By folding the coil substrate 20, a coilless part (PCO) is sandwiched between one coil part (PCW) and another coil part (PCW). A coilless part (PCO) is sandwiched between two coil parts (PCW). A coilless part (PCO) is arranged between one coil part (PCW) and another coil part (PCW). Therefore, an insulation interval between a coil (C) in one coil part (PCW) and a coil (C) in another coil part (PCW) can be increased. An insulation resistance between one coil part (PCW) and another coil part (PCW) can be increased.

The number of coilless parts (PCO) sandwiched between one coil part (PCW) and another coil part (PCW) is one or more. The number of coilless parts (PCO) sandwiched between two coil parts (PCW) is preferably 2.

Schemes for sandwiching a coilless part (PCO) are as follows.

Scheme 1: A coilless part (PCO) can be sandwiched between one primary coil part (PCW1) and one secondary coil part (PCW2). For example, a coilless part (PCO) can be sandwiched between one primary coil part (PCW1) and one first secondary coil part (PCW21). Or, a coilless part (PCO) can be sandwiched between one primary coil part (PCW1) and one second secondary coil part (PCW22). Or, a coilless part (PCO) can be sandwiched between one primary coil part (PCW1) and one third secondary coil part (PCW23). The first secondary coil part (PCW21) includes the first secondary coil (C21). The second secondary coil part (PCW22) includes the second secondary coil (C22). The third secondary coil part (PCW23) includes the third secondary coil (C23). The number of turns of the first secondary coil (C21), the number of turns of the second secondary coil (C22), and the number of turns of the third secondary coil (C23) are different from each other. Or, the number of turns of the first secondary coil (C21), the number of turns of the second secondary coil (C22), and the number of turns of the third secondary coil (C23) are equal to each other. The magnitude of the voltage generated between the starting end (SE) and the ending end (EE) of the first secondary coil (C21), the magnitude of the voltage generated between the starting end (SE) and the ending end (EE) of the second secondary coil (C22), and the magnitude of the voltage generated between the starting end (SE) and the ending end (EE) of the third secondary coil (C23) are different from each other. Or, the magnitude of the voltage generated between the starting end (SE) and the ending end (EE) of the first secondary coil (C21), the magnitude of the voltage generated between the starting end (SE) and the ending end (EE) of the second secondary coil (C22), and the magnitude of the voltage generated between the starting end (SE) and the ending end (EE) of the third secondary coil (C23) are equal to each other.

Scheme 2: A coilless part (PCO) can be sandwiched between one secondary coil part (PCW2) and another secondary coil part (PCW2). A secondary coil (C2) in one secondary coil part (PCW2) and a secondary coil (C2) in another secondary coil part (PCW2) are independent of each other. For example, the secondary coil (C2) in one secondary coil part (PCW2) is the first secondary coil (C21), and the secondary coil (C2) in another secondary coil part (PCW2) is the second secondary coil (C22). The secondary coil (C2) in one secondary coil part (PCW2) is the second secondary coil (C22), and the secondary coil (C2) in another secondary coil part (PCW2) is the third secondary coil (C23).

Scheme 3: A coilless part (PCO) can be sandwiched between two primary coil parts (PCW1).

The planar transformer 10 can have two schemes selected from the scheme 1, the scheme 2, and the scheme 3. For example, the planar transformer 10 has two schemes 1. Or, the planar transformer 10 has one scheme 1 and one scheme 2.

Examples of sandwiching a coilless part (PCO) are described. For example, one coil part (PCW) is a primary coil part (PCW1), and another coil part (PCW) is a secondary coil part (PCW2). The secondary coil part (PCW2) is the first secondary coil part (PCW21), the second secondary coil part (PCW22), or the third secondary coil part (PCW23).

The q-th portion (PC) is a coilless part (PCO). Then, when the coil substrate 20 is folded, the coilless part (q-th coilless part) (PCOq) forming the q-th portion (PC) is sandwiched between a primary coil part (PCW1) and a secondary coil part (PCW2). Then, the primary coil (C1) of the primary coil part (PCW1) sandwiching the q-th coilless part (PCOq) is projected on the first surface (F) of the q-th coilless part (PCO) with light perpendicular to the first surface (F) of the q-th coilless part (PCOq). In this case, a conductor circuit (DC) in the q-th coilless part (PCOq) and the primary coil (C1) do not overlap each other. Further, the primary coil (C1) of the primary coil part (PCW1) sandwiching the q-th coilless part (PCOq) is projected on the second surface (S) of the q-th coilless part (PCO) with light perpendicular to the first surface (F) of the q-th coilless part (PCOq). In this case, a conductor circuit (DC) in the q-th coilless part (PCOq) and the primary coil (C1) do not overlap each other. Further, the secondary coil (C2) of the secondary coil part (PCW2) sandwiching the q-th coilless part (PCOq) is projected on the first surface (F) of the q-th coilless part (PCO) with light perpendicular to the first surface (F) of the q-th coilless part (PCOq). In this case, a conductor circuit (DC) in the q-th coilless part (PCOq) and the secondary coil (C2) do not overlap each other. Further, the secondary coil (C2) of the secondary coil part (PCW2) sandwiching the q-th coilless part (PCOq) is projected on the second surface (S) of the q-th coilless part (PCO) with light perpendicular to the first surface (F) of the q-th coilless part (PCOq). In this case, a conductor circuit (DC) in the q-th coilless part (PCOq) and the secondary coil (C2) do not overlap each other.

The secondary coil part (PCW2) can be changed to a primary coil part (PCW1). In that case, the q-th coilless part is sandwiched between two primary coil parts (PCW1).

The r-th portion (PC) is a coilless part (PCO). Then, when the coil substrate 20 is folded, the coilless part (r-th coilless part) (PCOr) forming the r-th portion is sandwiched between a primary coil part (PCW1) and a secondary coil part (PCW2).

Then, the primary coil (C1) of the primary coil part (PCW1) sandwiching the r-th coilless part (PCOr) is projected on the first surface (F) of the r-th coilless part (PCO) with light perpendicular to the first surface (F) of the r-th coilless part (PCOr). In this case, the primary coil (C1) is positioned in the formation region (CA) above the first surface (F) of the r-th coilless part (PCOr). The first surface (F) in the formation region (CA) is completely exposed. Further, the primary coil (C1) of the primary coil part (PCW1) sandwiching the r-th coilless part (PCOr) is projected on the second surface (S) of the r-th coilless part (PCOr) with light perpendicular to the first surface (F) of the r-th coilless part (PCOr). In this case, the primary coil (C1) is positioned in the formation region (CA) above the second surface (S) of the r-th coilless part (PCOr). The second surface (S) in the formation region (CA) is completely exposed. Further, the secondary coil (C2) of the secondary coil part (PCW2) sandwiching the r-th coilless part (PCOr) is projected on the first surface (F) of the r-th coilless part (PCOr) with light perpendicular to the first surface (F) of the r-th coilless part (PCOr). In this case, the secondary coil (C2) is positioned in the formation region (CA) above the first surface (F) of the r-th coilless part (PCOr). The first surface (F) in the formation region (CA) is completely exposed. Further, the secondary coil (C2) of the secondary coil part (PCW2) sandwiching the r-th coilless part (PCOr) is projected on the second surface (S) of the r-th coilless part (PCOr) with light perpendicular to the first surface (F) of the r-th coilless part (PCOr). In this case, the secondary coil (C2) is positioned in the formation region (CA) above the second surface (S) of the r-th coilless part (PCOr). The second surface (S) in the formation region (CA) is completely exposed. The first surface (F) and the second surface (S) of the formation region (CA) in the coilless part (PCO) are completely exposed. The formation region (CA) is illustrated in FIG. 1B. The secondary coil part (PCW2) can be changed to a primary coil part (PCW1). In that case, the r-th coilless part is sandwiched between two primary coil parts (PCW1).

The t-th portion (PC) is a coilless part (PCO). Then, when the coil substrate 20 is folded, the coilless part (t-th coilless part) (PCOt) forming the t-th portion (PC) is sandwiched between a primary coil part (PCW1) and a secondary coil part (PCW2). In this case, the first surface (F) of the t-th coilless part (PCOt) is completely exposed. Further, the second surface (S) of the t-th coilless part (PCOt) is completely exposed. The secondary coil part (PCW2) can be changed to a primary coil part (PCW1). In that case, the t-th coilless part is sandwiched between two primary coil parts (PCW1).

Examples of a position of a coilless part (PCO) sandwiched between coil parts (PC) are described next. Examples of positions of coil parts (PCW) sandwiching a coilless part (PCO) are described next.

Example 1

Figure 1D:
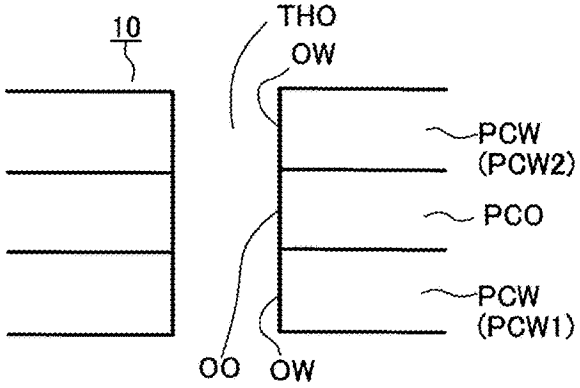
FIG. 1D schematically illustrates a cross section of a planar transformer.

The coil substrate 20 illustrated in FIG. 5B has one primary coil part (PCW1), one secondary coil part (PCW2), and one coilless part (PCO). The portion (first portion) (PC1) including the one-end (22SL) is the coilless part (PCO). The second portion (PC2) is the primary coil part (PCW1). The third portion (PC3) is the secondary coil part (PCW2). Then, by folding such a coil substrate 20, the first portion (PC1) is sandwiched between the second portion (PC2) and the third portion (PC3). In this case, the first portion (PC1) is stacked on the second portion (PC2). Further, the third portion (PC3) is stacked on the first portion (PC1). An example of a manufactured planar transformer 10 is illustrated in FIG. 1D.

Example 2

The coil substrate 20 has one primary coil part (PCW1), one secondary coil part (PCW2), and two coilless parts (PCO). The portion (first portion) (PC1) including the one-end (22SL) is a coilless part (PCO). The second portion (PC2) is a coilless part (PCO). The third portion (PC3) is the primary coil part (PCW1). The fourth portion (PC4) is the secondary coil part (PCW2). Then, by folding such a coil substrate 20, the first portion (PC1) and the second portion (PC2) are sandwiched between the third portion (PC3) and the fourth portion (PC4). In this case, the first portion (PC1) is stacked on the third portion (PC3). Further, the second portion (PC2) is stacked on the first portion (PC1). Further, the fourth portion (PC4) is stacked on the second portion (PC2).

Example 3

The coil substrate 20 has two primary coil parts (PCW1), two first secondary coil parts (PCW21), and two coilless parts (PCO).

The portion (first portion) (PC1) including the one-end (22SL) is a coilless part (PCO). The second portion (PC2) is a primary coil part (PCW1). The third portion (PC3) is a first secondary coil part (PCW21). The fourth portion (PC4) is a first secondary coil part (PCW21). The fourth portion (PC4) is also the (N−2)-th portion ($PCn^{-2}$). The fifth portion (PC5) is a primary coil part (PCW1). The fifth portion (PC5) is also the (N−1)-th portion ($PCn^{-1}$). The portion (sixth portion) (PC6) including the other-end (22SR) is a coilless part (PCO). The portion (PC) including the other-end (22SR) is also the N-th portion (PCN).

The primary coil (C1) in the primary coil part (PCW1) forming the second portion (PC2) and the primary coil (C1) in the primary coil part (PCW1) forming the fifth portion (PC5) are connected in series. For example, the ending end (EE) of the primary coil (C1) in one coil part (PC) is connected to the starting end (SE) of the primary coil (C1) in another coil part (PC). In this way, when the coil substrate 20 includes multiple primary coils (C1), all the primary coils (C1) are connected in series. Then, the starting end (SE) of the first primary coil (C1) is connected to the first input terminal (T11), and the ending end (EE) of the last primary coil (C1) is connected to the second input terminal (T12).

The first secondary coil (C21) in the first secondary coil part (PCW21) forming the third portion (PC3) and the first secondary coil (C21) in the first secondary coil part (PCW21) forming the fourth portion (PC4) are connected in series. For example, the ending end (EE) of the first secondary coil (C21) in one coil part (PC) is connected to the starting end (SE) of the first secondary coil (C21) in another coil part (PC). In this way, when the coil substrate 20 includes multiple first secondary coils (C21), all the first secondary coils (C21) are connected in series. Similarly, when the coil substrate 20 includes multiple second secondary coils (C22), all the second secondary coils (C22) are connected in series. When the coil substrate 20 includes multiple third secondary coils (C23), all the third secondary coils (C23) are connected in series. Then, the starting end (SE) of the first secondary coil (C2) is connected to the first output terminal (T21), and the ending end (EE) of the last secondary coil (C2) is connected to the second output terminal (T22).

By folding the coil substrate 20, the first portion (PC1) is sandwiched between the second portion (PC2) and the third portion (PC3). Further, the N-th portion (PCN) is sandwiched between (N−2)-th portion ($PCn^{-2}$) and (N−1)-th portion ($PCn^{-1}$). In this case, the first portion (PC1) is stacked on the second portion (PC2). Further, the third portion (PC3) is stacked on the first portion (PC1). Further, the N-th portion (PCN) is stacked on the (N−1)-th portion ($PCn^{-1}$). Further, the (N−2)-th portion ($PCn^{-2}$) is stacked on the N-th portion (PCN). All the remaining portions (PC) can be sandwiched between the two primary coil parts (PCW1).

Example 4

The coil substrate 20 has two primary coil parts (PCW1), two first secondary coil parts (PCW21), and four coilless parts (PCO).

The portion (first portion) (PC1) including the one-end (22SL) is a coilless part (PCO). The second portion (PC2) is a coilless part (PCO). The third portion (PC3) is a primary coil part (PCW1). The fourth portion (PC4) is a first secondary coil part (PCW21). The (N−3)-th portion ($PCn^{-3}$) is a first secondary coil part (PCW21). The (N−2)-th portion ($PCn^{-2}$) is a primary coil part (PCW1). The (N−1)-th portion ($PCn^{-1}$) is a coilless part (PCO). The N-th portion (PCN) is a coilless part (PCO).

By folding the coil substrate 20, the first portion (PC1) and the second portion (PC2) are sandwiched between the third portion (PC3) and the fourth portion (PC4). The (N−1)-th portion ($PCn^{-1}$) and the N-th portion (PCN) are sandwiched between the (N−3)-th portion ($PCn^{-3}$) and the (N−2)-th portion ($PCn^{-2}$). In this case, the first portion (PC1) is stacked on the third portion (PC3). Further, the second portion (PC2) is stacked on the first portion (PC1). Further, the fourth portion (PC4) is stacked on the second portion (PC2). Further, the N-th portion (PCN) is stacked on the (N−2)-th portion ($PCn^{-2}$). Further, the (N−1)-th portion ($PCn^{-1}$) is stacked on the N-th portion (PCN). Further, the (N−3)-th portion ($PCn^{-3}$) is stacked on the (N−1)-th portion ($PCn^{-1}$).

Example 5

The coil substrate 20 has two primary coil parts (PCW1), two first secondary coil parts (PCW21), and four coilless parts (PCO).

The first portion (PC1) is a coilless part (PCO). The second portion (PC2) is a coilless part (PCO). The third portion (PC3) is a coilless part (PCO). The fourth portion (PC4) is a coilless part (PCO). The fifth portion (PC5) is a primary coil part (PCW1). The sixth portion (PC6) is a first secondary coil part (PCW21). The seventh portion (PC7) is a first secondary coil part (PCW21). The seventh is the (N−1)-th. The eighth portion (PC8) is a primary coil part (PCW1). The eighth is the N-th.

By folding the coil substrate 20, the first portion (PC1) and the fourth portion (PC4) are sandwiched between the fifth portion (PC5) and the sixth portion (PC6). The second portion (PC2) and the third portion (PC3) are sandwiched between the (N−1)-th portion ($PCn^{-1}$) and the N-th portion (PCN).

In this case, the fourth portion (PC4) is stacked on the fifth portion (PC5). Further, the first portion (PC1) is stacked on the fourth portion (PC4). Further, the sixth portion (PC6) is stacked on the first portion (PC1). Further, the (N−1)-th portion ($PCn^{-1}$) is stacked on the sixth portion (PC6). Further, the second portion (PC2) is stacked on the (N−1)-th portion ($PCn^{-1}$). Further, the third portion (PC3) is stacked on the second portion (PC2). Further, the N-th portion (PCN) is stacked on the third portion (PC3). All the remaining portions (PC) can be sandwiched between the two primary coil parts (PCW1).

As illustrated in the example, there is no restriction on the arrangement of the coil parts (PCW) and the coilless parts (PCO) in the coil substrate 20. There is no restriction on the arrangement of the coilless parts (PCO) sandwiched between the coil parts (PCW) in the coil substrate 20. There is no restriction on the arrangement of the coil parts (PCW) sandwiched between the coilless parts (PCO) in the coil substrate 20.

The coils (C) are formed only on the first surface (F) of the flexible substrate 22. Or, the coils (C) are formed on the both sides of the flexible substrate 22. A coil (C) on the first surface (F) is an upper coil, and a coil (C) on the second surface (S) is a lower coil. An upper coil and a lower coil are connected to each other by a through-hole conductor (TH) penetrating the flexible substrate 22.

As illustrated in FIG. 2D, a coil part (PCW) can have in the central space (SC) an opening (first opening) (OW) penetrating the flexible substrate 22.

As illustrated in FIG. 2E, a coilless part (PCO) can have an opening (second opening) (OO) penetrating the flexible substrate 22.

In the planar transformer 10, a first opening (OW) is stacked on a second opening (OO). When the first openings (OW) and the second openings (OO) are observed from a position above the planar transformer 10, the first openings (OW) and the second openings (OO) overlap each other. As illustrated in FIG. 1D, the planar transformer 10 has a through hole (THO). The through hole (THO) penetrating the planar transformer 10 include all the first openings (OW) and all the second openings (OO).

First Embodiment

FIGS. 1A and 2A illustrate the coil substrate 20 of the first embodiment. The flexible substrate 22 forming the coil substrate 20 has a substantially rectangular shape.

FIG. 1A illustrates the first surface (F) of the flexible substrate 22 and the coils (upper coils) (CF) on the first surface (F). FIG. 2A illustrates the second surface (S) of the flexible substrate 22 and the coils (lower coils) (CS) on the second surface (S). The coils (C) and the conductor circuits (DC) other than the coils (C) illustrated in FIG. 2A are observed from a position above the first surface (F).

The coil substrate 20 is formed of 10 portions (PC). The coil substrate 20 is folded between the m-th portion (PC) and the (m+1)-th portion (PC). The planar transformer 10 illustrated in FIG. 4A is formed.

As illustrated in FIG. 1A, the coil substrate 20 has two primary coils (C1AF, C1BF) and four secondary coils (C2AF, C2BF, C2CF, C2DF) on the first surface (F) of the flexible substrate 22. The primary coil (C1AF) is a first primary coil (C11). The primary coil (C1BF) is a second primary coil (C12). The secondary coil (C2AF) is a first secondary coil (C21). The secondary coil (C2BF) is a second secondary coil (C22). The secondary coil (C2CF) is a third secondary coil (C23). The secondary coil (C2DF) is a fourth secondary coil (C24).

As illustrated in FIG. 2A, the coil substrate 20 has four secondary coils (C2AB, C2BB, C2CB, C2DB) on the second surface (S) of the flexible substrate 22. The secondary coil (C2AB) is a first secondary coil (C21). The secondary coil (C2BB) is a second secondary coil (C22). The secondary coil (C2CB) is a third secondary coil (C23). The secondary coil (C2DB) is a fourth secondary coil (C24).

As illustrated in FIGS. 1A and 2A, the upper coils (CF) and the lower coils (CS) are arranged along the upper side (22LU).

As illustrated in FIGS. 1A and 2A, in the first embodiment, the primary coils (C1) are formed only on the first surface (F) of the flexible substrate 22. A coil part (PCW) has at least one of an upper coil (CF) and a lower coil (CS). A coilless part (PCO) has neither an upper coil (CF) nor a lower coil (CS).

When one coil part (PC) has an upper coil (CF) and a lower coil (CS), the upper coil (CF) and the lower coil (CS) are connected to each other by a through-hole conductor (TH) penetrating the flexible substrate 22. Then, the upper coil (CF) and the lower coil (CS) are substantially symmetrically formed via the flexible substrate 22. Further, the upper coil (CF) and the lower coil (CS) are coils (C) of the same type. For example, the upper coil (CF) and the lower coil (CS) are primary coils (C1). The upper coil (CF) and the lower coil (CS) are secondary coils (C2). The upper coil (CF) and the lower coil (CS) are first secondary coils (C21). The upper coil (CF) and the lower coil (CS) are second secondary coils (C22). The upper coil (CF) and the lower coil (CS) are third secondary coils (C23). The upper coil (CF) and the lower coil (CS) are fourth secondary coils (C24).

As illustrated in FIGS. 1A and 2A, the third to eighth portions (PC) are formed of coil parts (PCW). The third portion (PC3) and the eighth portion (PC8) have the primary coils (C1). The third portion (PC3) and the eighth portion (PC8) are the primary coil parts (PCW1). The fourth to seventh portions have the secondary coils (C2). The fourth to seventh portions (PC) are the secondary coil parts (PCW2). The fourth portion (PC4) is a first secondary coil part (PCW21). The fifth portion (PC5) is a second secondary coil part (PCW22). The sixth portion (PC6) is a third secondary coil part (PCW23). The seventh portion (PC7) is a fourth secondary coil part (PCW24). The first portion (PC1), the second portion (PC2), the ninth portion (PC9), and the tenth portion (PC10) are each formed of a coilless part (PCO).

The portions (PC) are arranged between the one-end (22SL) and the other-end (22SR) such that the coil parts (PCW) and the coilless parts (PCO) form a row.

As illustrated in FIGS. 1A and 2A, in the first embodiment, each of the coilless parts (PCO) does not have an input line or an output line. The first surface (F) and the second surface (S) of each of the coilless parts are completed exposed.

As illustrated in FIGS. 1A and 2A, the coil substrate 20 can have terminal substrates (22EU, 22ED). The terminal substrates (22EU, 22ED) each have at least one of the input terminals (T1) and the output terminals (T2). In FIG. 1A, the coil substrate 20 has the two terminal substrates (22EU, 22ED). The terminal substrates (22EU, 22ED) each have a first surface (F) and a second surface (S). The first surface (F) of the flexible substrate 22 and the first surfaces (F) of the terminal substrates (22EU, 22ED) are the same surface. The second surface (S) of the flexible substrate 22 and the second surfaces (S) of the terminal substrates (22EU, 22ED) are the same surface.

The terminal substrate (first terminal substrate) (22EU) extends from an upper side (LU) of the flexible substrate 22. The first terminal substrate (22EU) has the output terminals (T2).

The terminal substrate (second terminal substrate) (22ED) extends from a lower side (LD) of the flexible substrate 22. The second terminal substrate (22ED) has the input terminals (T1). The coil substrate 20 of each embodiment can have the terminal substrates (22EU, 22ED).

As illustrated in FIG. 2A, the second terminal substrate (22ED) has two input terminals (T1). The two input terminals (T1) are formed on the second surface (S) of the second terminal substrate (22ED).

The two input terminals (T1) are a first input terminal (T11) and a second input terminal (T12).

The coil substrate 20 of the first embodiment has four types of secondary coils (C2). Therefore, the coil substrate 20 has eight output terminals (T2) on the first terminal substrate (22EU). As illustrated in FIG. 2A, the eight output terminals (T2) are formed on the second surface (S) of the first terminal substrate (22EU).

The eight output terminals (T2) are a first output terminal (T21), a second output terminal (T22), a third output terminal (T23), a fourth output terminal (T24), a fifth output terminal (T25), a sixth output terminal (T26), a seventh output terminal (T27), and an eighth output terminal (T28).

In the first embodiment, the first input terminal (T11) and the second input terminal (T12) are connected to each other via a conductor circuit (DC) connecting the first input terminal (T11) to the first primary coil (C11), a conductor circuit (DC) connecting the first primary coil (C11) to the second primary coil (C12), and a conductor circuit (DC) connecting the second primary coil (C12) to the second input terminal (T12). The first input terminal (T11), the first primary coil (C11), the second primary coil (C12), and the second input terminal (T12) are connected in series. The conductor circuits (DC) formed between the first input terminal (T11) and the second input terminal (T12) include input lines (L1). Each of the input lines (L1) does not include a wiring (w) that forms a coil (C).

The conductor circuit (DC) connecting the first input terminal (T11) to the first primary coil (C11) is formed by a through-hole conductor (T1At) and a conductor pattern (first input line (L11)), the through-hole conductor (T1At) being connected to the first input terminal (T11) and penetrating the flexible substrate 22, and the first input line (L11) being formed on the first surface (F) and extending from the through-hole conductor (T1At). The first input line (L11) is connected to the starting end (SE) of the first primary coil (C11).

The conductor circuit (DC) connecting the first primary coil (C11) to the second primary coil (C12) is formed by a through-hole conductor (C1AFt) and a conductor pattern (second input line (L12)), the through-hole conductor (C1AFt) being connected to the ending end (EE) of the first primary coil (C11) and penetrating the flexible substrate 22, and the second input line (L12) being formed on the second surface (S) and extending from the through-hole conductor (C1AFt). The second input line (L12) extends to a through-hole conductor (C1BFt) connected to the ending end (EE) of the second primary coil (C12).

The conductor circuit (DC) connecting the second primary coil (C12) to the second input terminal (T12) is formed by a conductor pattern (third input line (L13)) that is formed on the first surface (F) and extends from the starting end (SE) of the second primary coil (C12). The third input line (L13) extends to a through-hole conductor (T1Bt). Then, the through-hole conductor (T1Bt) is connected to the second input terminal (T12).

The conductor patterns on the first surface and the conductor patterns on the second surface form the input lines (L1). The first input terminal (T11) and the second input terminal (T12) are electrically connected to each other via the input lines (L1). The input lines (L1) are formed along the lower side (22LD). The input lines (L1) are formed between the lower side (22LD) and the coils (C).

A voltage is applied between the first input terminal (T11) and the second input terminal (T12). A current flows from the first input terminal (T11) to the second input terminal (T12).

When the coil substrate 20 is folded, the second primary coil (C12) is stacked on the first primary coil (C11). The first primary coil (C11) and the second primary coil (C12) face each other. In the planar transformer 10, the direction of the current flowing in the first primary coil (C11) is the same as the direction of the current flowing in the second primary coil (C12).

In the first embodiment, the first output terminal (T21) and the second output terminal (T22) are connected to each other via a conductor circuit (DC) connecting the first output terminal (T21) to the first secondary coils (C21) and a conductor circuit (DC) connecting the first secondary coils (C21) to the second output terminal (T22).

The first secondary coils (C21) include the first secondary coil (C21) formed on the first surface (F) and the first secondary coil (C21) formed on the second surface (S). The ending end (EE) of the first secondary coil (C21) formed on the first surface (F) and the ending end (EE) of the first secondary coil (C21) formed on the second surface (S) are connected to each other by a through-hole conductor (CAFt) penetrating the flexible substrate 22.

The first output terminal (T21) is connected via the conductor circuit (DC) to the starting end (SE) of the first secondary coil (C21) formed on the first surface (F). Or, the first output terminal (T21) is connected via the conductor circuit (DC) to the starting end (SE) of the first secondary coil (C21) formed on the second surface (S).

When the first output terminal (T21) is connected to the starting end (SE) of the first secondary coil (C21) formed on the first surface (F), the first secondary coil (C21) formed on the second surface (S) is connected to the second output terminal (T22) via a conductor circuit (DC) extending from the starting end (SE) of the first secondary coil (C21) formed on the second surface (S).

When the first output terminal (T21) is connected to the starting end (SE) of the first secondary coil (C21) formed on the second surface (S), the first secondary coil (C21) formed on the first surface (F) is connected to the second output terminal (T22) via a conductor circuit (DC) extending from the starting end (SE) of the first secondary coil (C21) formed on the first surface (F).

In this way, the first output terminal (T21) and the secondary coils (C2) are connected to each other via the conductor circuits (DC). The second output terminal (T22) and the secondary coils (C2) are connected to each other via the conductor circuits (DC). The conductor circuits (DC) that electrically connected to each other the first output terminal (T21) and the second output terminal (T22) each include at least one of a through-hole conductor, a conductor pattern on the first surface (F), and a conductor pattern on the second surface (S). The conductor pattern on the first surface (F) and the conductor pattern on the second surface (S) form output lines (L2). The output lines (L2) are formed along the upper side (22LU). The output lines (L2) are formed between the upper side (22LU) and the coils (C).

Even when the first secondary coils (C21) are another kind of secondary coils (C2), the method for the connection between the two output terminals (T2) is the same.

When the coil substrate 20 is folded, the first secondary coils (C21) are stacked on the primary coils (C1). The primary coils (C1) and the first secondary coils (C21) face each other.

When a current flows in the primary coils (C1) in the planar transformer 10, a current flows in the first secondary coils (C21) in the planar transformer 10. When secondary coils (C2) of the same type are formed in different portions (PC), in the planar transformer 10, directions of currents flowing in the secondary coils (C2) of the same type are the same.

When a current flows in the primary coils (C1), currents are induced in the first secondary coils (C21), the second secondary coils (C22), the third secondary coils (C23), and the fourth secondary coils (C24). In the planar transformer 10, the coils (C) overlap each other. That is, when all the coils (C) in the planar transformer 10 are projected on the first surface (F) of the first portion (PC1) with light perpendicular to the first surface (F) of the first portion (PC1), all the coils (C) substantially overlap each other. Therefore, currents can be induced with high efficiency in the secondary coils (C2) of the respective types.

As illustrated in FIG. 1A, the coil substrate 20 has a bending part (BP) between the m-th portion (PCm) and the (m+1)-th portion (PCm1). The coil substrate 20 is folded along the bending parts (BP).

Figure 3A:
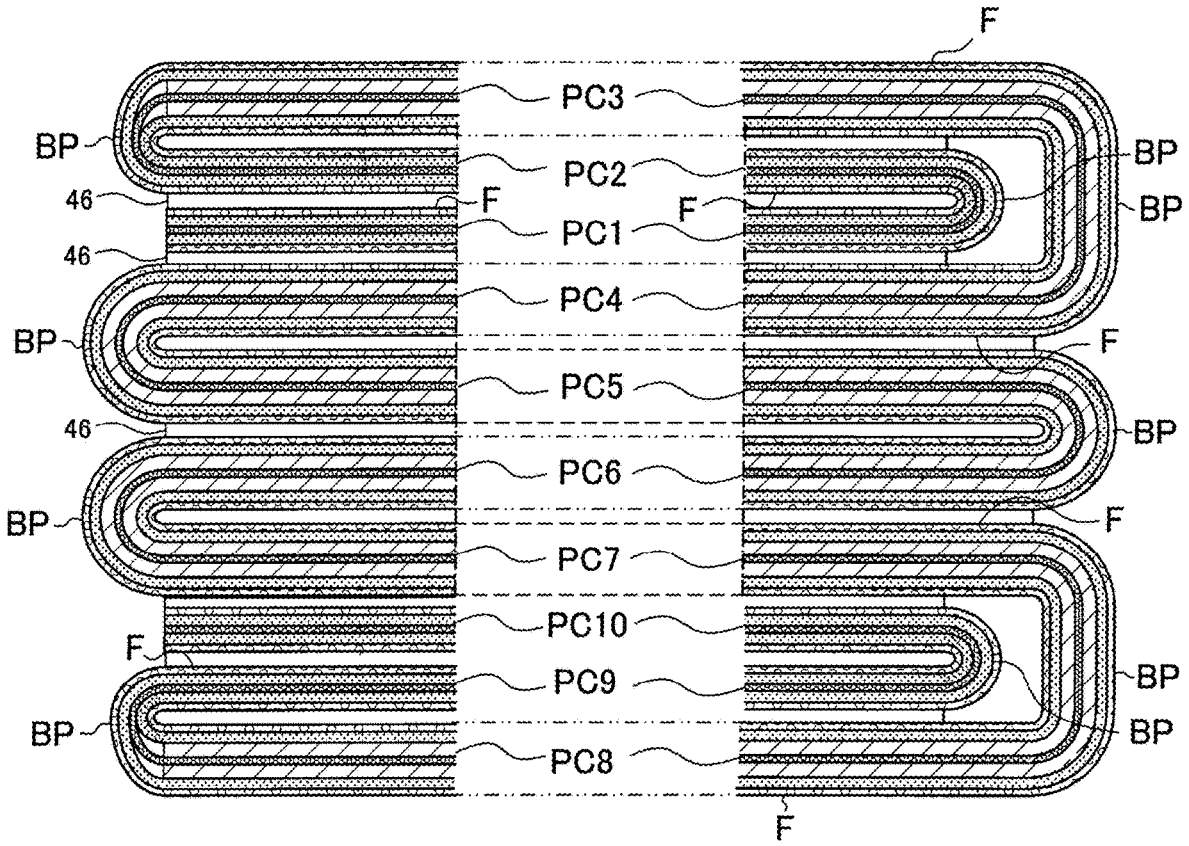
FIG. 3A is a schematic diagram of a cross section of the planar transformer of the first embodiment.

As illustrated in FIG. 3A, the coil substrate 20 is folded along the bending part (BP) positioned between the first portion (PC1) and the second portion (PC2) such that the first surface (F) of the first portion (PC1) and the first surface (F) of the second portion (PC2) face each other.

The coil substrate 20 is folded along the bending part (BP) positioned between the second portion (PC2) and the third portion (PC3) such that the second surface (S) of the second portion (PC2) and the second surface (S) of the third portion (PC3) face each other.

The coil substrate 20 is folded along the bending part (BP) positioned between the third portion (PC3) and the fourth portion (PC4) such that the second surface (S) of the first portion (PC1) and the second surface (S) of the fourth portion (PC4) face each other.

The coil substrate 20 is folded along the bending part (BP) positioned between the ninth portion (PC9) and the tenth portion (PC10) such that the first surface (F) of the ninth portion (PC9) and the first surface (F) of the tenth portion (PC10) face each other. The tenth is the N-th, and the ninth is the (N−1)-th.

The coil substrate 20 is folded along the bending part (BP) positioned between the eighth portion (PC8) and the ninth portion (PC9) such that the second surface (S) of the ninth portion (PC9) and the second surface (S) of the eighth portion (PC8) face each other. The eighth is the (N−2)-th.

The coil substrate 20 is folded along the bending part (BP) positioned between the seventh portion (PC7) and the eighth portion (PC8) such that the second surface (S) of the tenth portion (PC10) and the second surface (S) of the seventh portion (PC7) face each other. The seventh is the (N−3)-th.

The coil substrate 20 is folded along the bending part (BP) positioned between the fourth portion (PC4) and the fifth portion (PC5) such that the first surface (F) of the fourth portion (PC4) and the first surface (F) of the fifth portion (PC5) face each other.

The coil substrate 20 is folded along the bending part (BP) positioned between the fifth portion (PC5) and the sixth portion (PC6) such that the second surface (S) of the fifth portion (PC5) and the second surface (S) of the sixth portion (PC6) face each other.

The coil substrate 20 is folded along the bending part (BP) positioned between the sixth portion (PC6) and the seventh portion (PC7) such that the first surface (F) of the sixth portion (PC6) and the first surface (F) of the seventh portion (PC7) face each other.

The portions are stacked in the order of the eighth, the ninth, the tenth, the seventh, the sixth, the fifth, the fourth, the first, the second, and the third.

The ninth portion (coilless part) and the tenth portion (coilless part) are sandwiched between the eighth portion (primary coil part) and the seventh portion (secondary coil part). Insulation reliability between the primary coil (C1) (the primary coil in the eighth portion) and the secondary coil (C2) (the secondary coil in the seventh portion) can be increased.

The first portion (coilless part) and the second portion (coilless part) are sandwiched between the third portion (primary coil part) and the fourth portion (secondary coil part). Insulation reliability between the primary coil (C1) (the primary coil in the third portion) and the secondary coil (C2) (the secondary coil in the fourth portion) can be increased.

In the example of FIG. 2A, the eighth portion does not have a coil (C) on the second surface (S). Therefore, the distance between the primary coil (C1) in the eighth portion and the secondary coil (C2) (the secondary coil on the second surface (S) in the seventh portion) closest to the primary coil (C1) in the eighth portion can be increased. A large voltage can be applied to the primary coil (C1). The third part does not have a coil (C) on the second surface (S). Therefore, the distance between the primary coil (C1) in the third portion and the secondary coil (C2) (the secondary coil on second surface (S) in the fourth portion) closest to the primary coil (C1) in the third portion can be increased. A large voltage can be applied to the primary coil (C1). In this way, when a coil part (PC) only has a coil (C) on the first surface (F), the distance between the coil (C) in the coil part (PC) and a coil (C) in another coil part (PC) can be increased. A planar transformer 10 having high insulation reliability can be provided. A primary coil part (PCW1) can have a coil (C) only on the first surface (F). A secondary coil part (PCW2) can have a coil (C) only on the first surface (F).

In the primary transformer 10 of the first embodiment, all the secondary coils (C2) are sandwiched between the two primary coils (C1). As a result, leakage of magnetic flux can be reduced. Efficiency of the planar transformer 10 can be increased.

The planar transformer 10 is formed by folding the one coil substrate 20. Therefore, according to the embodiment, there is no need to prepare multiple substrates having coils. There is no need to stack multiple substrates having coils. The measuring time can be shortened. The manufacturing cost can be reduced.

The coil parts (PCW) and the coilless parts (PCO) are formed from the one flexible substrate 22. Therefore, in the planar transformer 10, positions of the coil parts (PCW) and positions of the coilless parts (PCO) match each other with high precision.

Figure 5C:
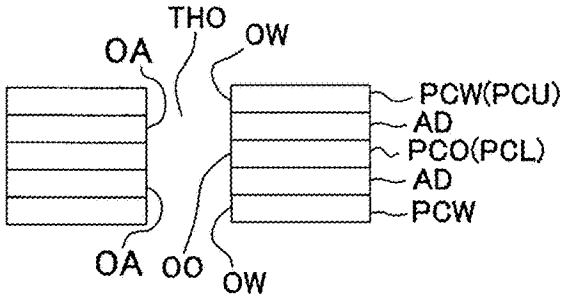
FIG. 5C is a schematic diagram of a cross section of a planar transformer.

As illustrated in FIG. 5C, the coil substrate 20 is folded such that an adhesive layer (AD) is sandwiched between one portion (lower portion) (PCL) and another portion (upper portion) (PCU) stacked on the one portion. The lower portion (PCL) and the upper portion (PCU) are bonded to each other by the adhesive layer (AD). The adhesive layer (AD) has an opening (OA). When the planar transformer 10 is formed by the coil substrate 20 and the adhesive layers (AD), the openings (OA) of the adhesive layers are positioned on the first openings (OW). The openings (OA) of the adhesive layers are positioned on the second openings (OO). When the first openings (OW), the second openings (OO), and the openings (OA) are observed from a position above the planar transformer 10, the first openings (OW), the second openings (OO), and the openings (OA) overlap each other. As illustrated in FIG. 5C, the through hole (THO) penetrating the planar transformer 10 is formed by all the first openings (OW), all the second openings (OO), and all the openings (OA).

An iron core is inserted into the through hole (THO) penetrating the planar transformer 10.

As illustrated in FIG. 4A, the planar transformer 10 is mounted on the printed wiring board 50 via the input terminals (T1) and the output terminals (T2) formed on the terminal substrates (22EU, 22ED). The first terminal substrate (22EU) protrudes from the upper side (22LU). The second terminal substrate (22ED) protrudes from the lower side (22LD). The terminals (the input terminals (T1) and the output terminals (T2)) face the printed wiring board 50. Therefore, the planar transformer 10 can be mounted on the printed wiring board 50 via solders. The planar transformer 10 can be arranged inside an opening (500) of the printed wiring board 50.

As illustrated in FIG. 1A, the coil substrate 20 of each of the embodiments can have an opening part (PS) in each of the bending parts (BP). An example of a shape of the opening part (PS) is an hourglass shape. When the coil substrate 20 is folded, the flexible substrate 22 is damaged. However, since the coil substrate 20 has the opening parts (PS), the damage can be reduced.

As illustrated in FIG. 1A, the coil substrate 20 of each of the embodiments has alignment marks (AM). The portions (PC) each have an alignment mark (AM). An example of each of the alignment marks (AM) is a hole penetrating the flexible substrate 22. The coil substrate 20 is folded using the alignment marks (AM). For example, alignment is performed by inserting a pin into the holes forming the alignment marks (AM). Therefore, a position of a coil (C) formed in a lower portion (PCL) and a position of a coil (C) formed in an upper portion (PCU) match each other with high precision. Efficiency of electromagnetic induction can be increased. When a current is generated by electromagnetic induction, loss of the generation can be reduced.

As illustrated in FIG. 2B, each coilless part (PCO) has a width (W0). As illustrated in FIG. 1B, each coil part (PCW) has a width (W1). The width (W0) and the width (W1) are preferably substantially equal to each other.

Figure 3B:
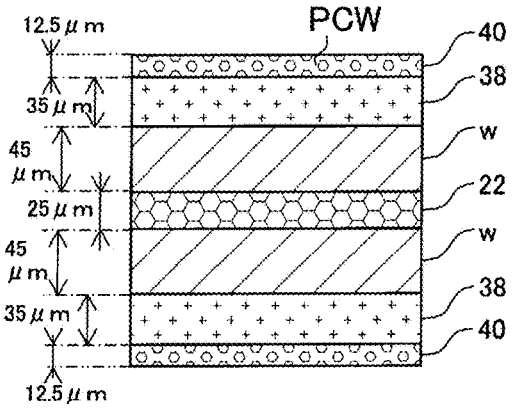
FIG. 3B illustrates an example of a cross section of a coil part.

FIG. 3B illustrates a cross section of a coil part (PCW) that has a coil (C) on the first surface (F) and a coil (C) on the second surface (S). The coil part (PCW) in FIG. 3B is formed by a flexible substrate 22 formed of polyimide, a wiring (w) on the flexible substrate 22, an adhesive 38 on the flexible substrate 22 and the wiring (w), and a cover film 40 on the adhesive 38. The wiring (w), the adhesive 38 and the cover film 40 are formed on both sides of the flexible substrate 22.

The flexible substrate 22 has a thickness of 25 μm. The wiring (w) is formed by a copper foil and copper plating film on the copper foil. The wiring (w) has a thickness of 45 μm, the copper foil has a thickness of 35 μm, and the plating film has a thickness of 10 μm. The adhesive 38 has a thickness of 35 μm. The cover film 40 has a thickness of 12.5 μm.

Figure 3C:
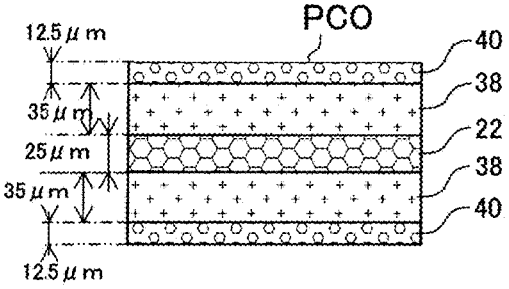
FIG. 3C illustrates an example of a cross section of a coilless part.

FIG. 3C illustrates a cross section of a coilless part (PCO). The coilless part (PCO) in FIG. 3C does not have a coil on the first surface (F) or on the second surface (S). The coilless part (PCO) in FIG. 3C is formed by removing the coils (C) from the coil part (PCW) in FIG. 3B.

In the planar transformer 10 of the first embodiment, the secondary coils (C2AF, C2BF, C2CF, C2DF) are formed on the first surface (F) of the flexible substrate 22. The secondary coils (C2AB, C2BB, C2CB, C2DB) are formed on the second surface (S) of the flexible substrate 22.

The first terminal substrate (22EU) and the second terminal substrate (22ED) are preferably connected to the same portion. The first terminal substrate (22EU) and the second terminal substrate (22ED) extend from the m-th portion. For example, the terminal substrates (22EU, 22ED) are connected to one primary coil part (PCW1). The output terminals (T2) and the input terminals (T1) are arranged near one of the primary coils (C1). Wirings between the printed wiring board 50 on which the planar transformer 10 is mounted and the coils (C) can be shortened. The input lines (L1) and the output lines (L2) can be shortened. The input lines (L1) are formed along the lower side (22LD) of the flexible substrate 22. The output lines (L2) are formed along the upper side (22LU) of the flexible substrate 22. Therefore, insulation reliability between the input lines (L1) and the output lines (L2) can be improved.

Second Embodiment

Figure 6:
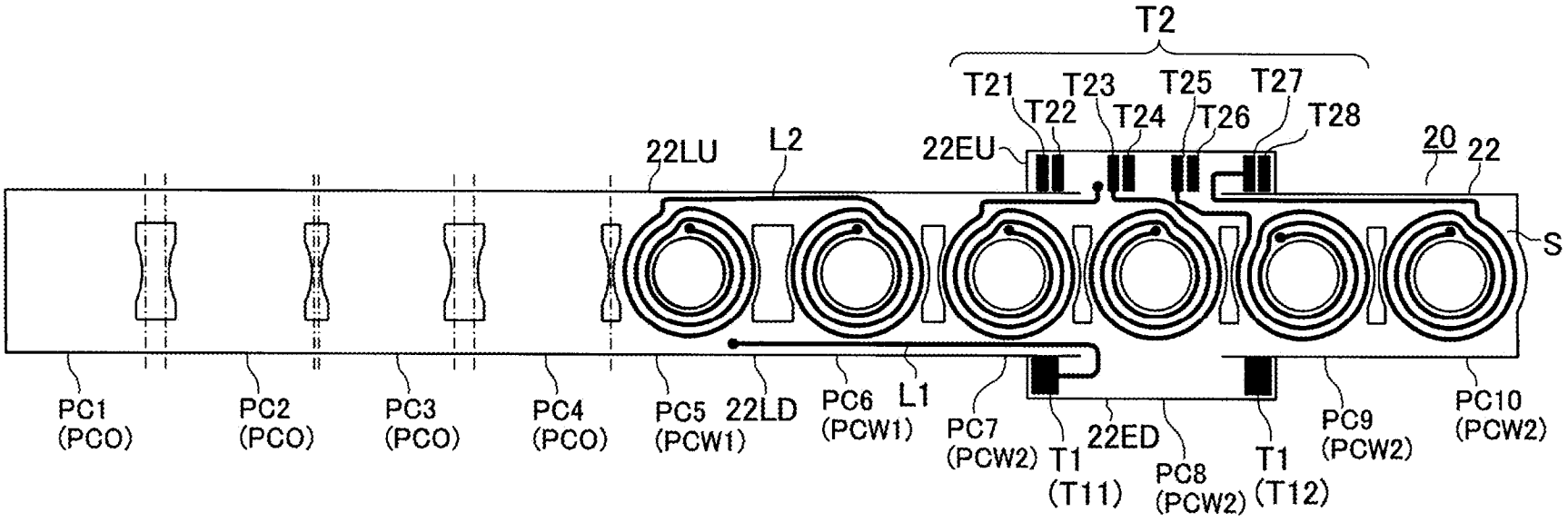
FIG. 6 illustrates a second surface of the coil substrate for manufacturing the planar transformer of the second embodiment.

FIGS. 5A and 6 illustrate the coil substrate 20 for manufacturing the planar transformer 10 of the second embodiment. FIG. 5A illustrates the first surface (F) of the coil substrate 20. FIG. 6A illustrates the second surface (S) of the coil substrate 20. The coils (C), the terminals (T1, T2) and the conductor patterns (DC) on the second surface (S) are observed from a position above the first surface (F). The coil substrate 20 is formed of 10 portions. The first to fourth portions (PC) are coilless parts (PCO). The fifth to tenth (N-th) portions (PC) are coil parts (PCW). The fifth portion (PC5) and the sixth portion (PC6) are the primary coil parts (PCW1). The seventh to tenth portions (PC) are the secondary coil parts (PCW2). The coil parts (PCW) have coils (C) on both sides of the flexible substrate 22.

The primary coils (C1) are connected in series. The first input terminal (T11), the primary coil (C1) on the second surface (S) in one of the primary coil parts (PCW1), the primary coil (C1) on the first surface (F) in the one of the primary coil parts (PCW1), the primary coil (C1) on the first surface (F) in the other one of the primary coil parts (PCW1), the primary coil (C1) on the second surface (S) in the other one of the primary coil parts (PCW1), and the second input terminal (T12) are connected in this order. For example, the fifth portion (PC5) is the one of the primary coil parts (PCW1), and the sixth portion (PC6) is the other one of the primary coil parts (PCW1).

The coil substrate 20 of the second embodiment has terminal substrates (22EU, 22ED) that extend from one secondary coil part (PCW2). In the second embodiment, the terminal substrates (22EU, 22ED) are connected to the eighth portion (PC8). The terminal substrates (22EU, 22ED) are connected to one coil part (PCW). Then, the first terminal substrate (22EU) extends from the upper side (22LU). The second terminal substrate (22ED) extends from the lower side (22LD). The input lines (L1) and the output lines (L2) can be shortened. Resistances of the input lines (L1) and the output lines (L2) can be reduced.

In the planar transformer 10 of the second embodiment, the two primary coil parts (PCW1) are adjacent to each other. Therefore, a wiring connecting the two primary coils (C1) can be shortened. The input lines (L1) can be shortened. Resistances of the input lines can be reduced. For example, the (N−1)-th and the N-th portions may be the primary coil parts (PCW1). Then, the remaining coil parts (PCW) are the secondary coil parts (PCW2).

Figure 7A:
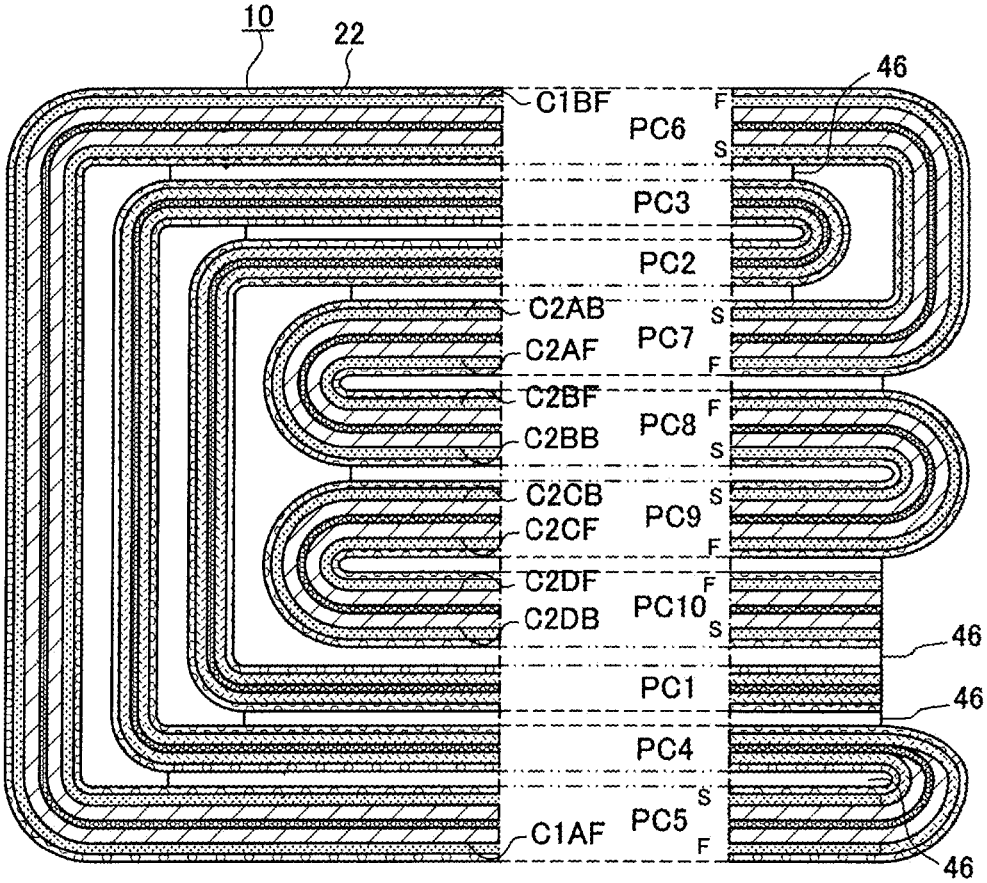
FIG. 7A is a schematic diagram of a cross section of the planar transformer of the second embodiment.
Figure 7B:
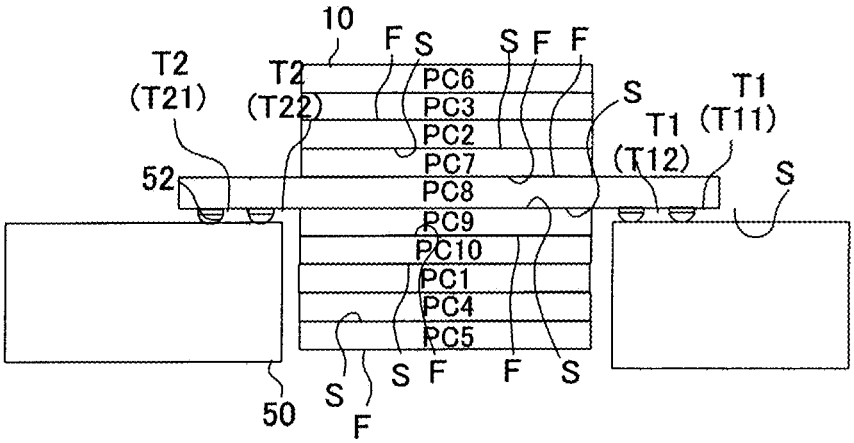
FIG. 7B illustrates a cross-sectional view of a printed wiring board and the planar transformer of the second embodiment mounted on the printed wiring board.

By folding the coil substrate 20 illustrated in FIGS. 5A and 6, the planar transformer 10 of the second embodiment shown in FIGS. 7A and 7B is formed. The coil substrate 20 is folded between the m-th portion (PCm) and the (m+1)-th portion (PCm1). The portions (PC) are stacked in the order of the fifth portion (PC5), the fourth portion (PC4), the first portion (PC1), the tenth portion (PC10), the ninth portion (PC9), the eighth portion (PC8), the seventh portion (PC7), the second portion (PC2), the third portion (PC3), and the sixth portion (PC6). Two coilless parts (PCO) are sandwiched between one primary coil part (PCW1) and one secondary coil part (PCW2). The secondary coil parts (PCW2) are continuously stacked.

One of the two primary coil parts (PCW1) is formed at an uppermost position in the planar transformer 10. And the other one of the two primary coil parts (PCW1) is formed at a lowest position in the planar transformer 10. The remaining coil parts (PC) can be sandwiched between the two primary coil parts (PCW1).

Third Embodiment

Figure 4B:
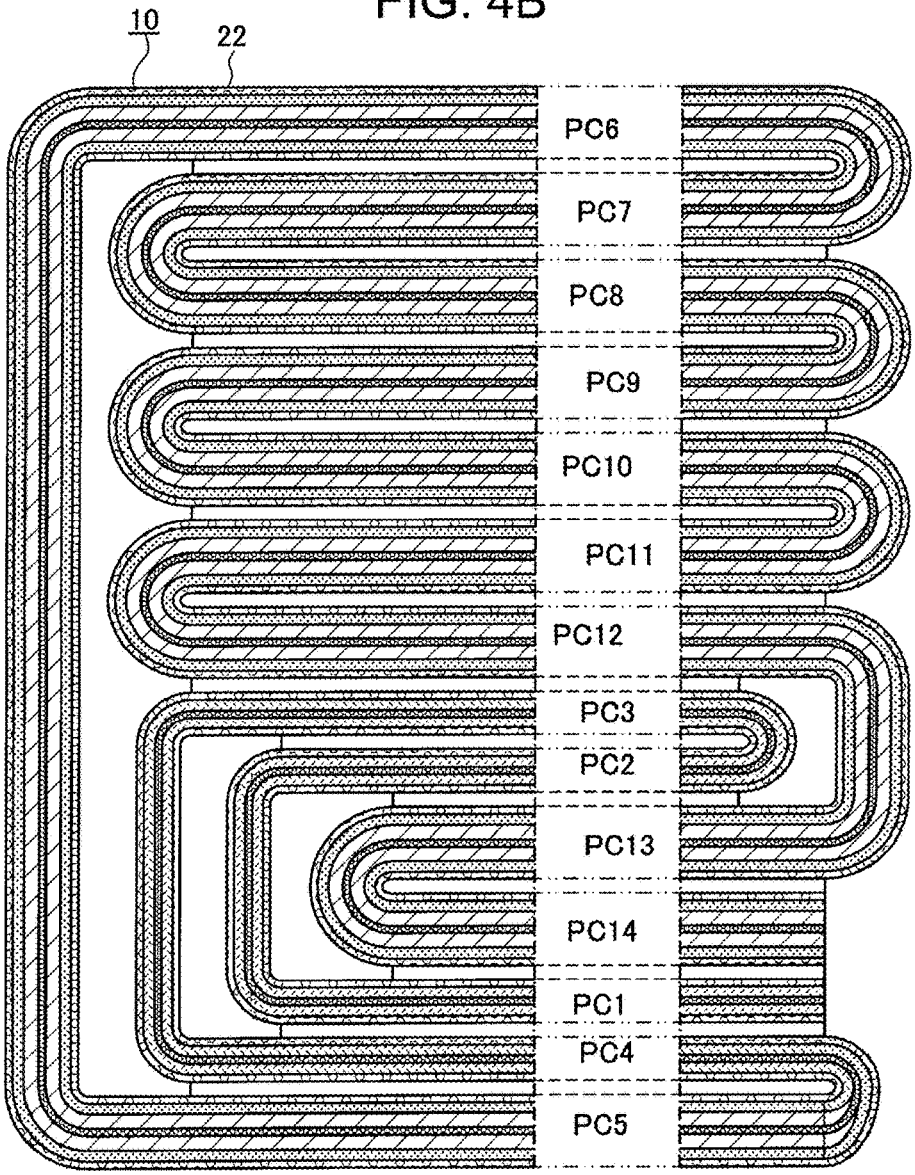
FIG. 4B is a schematic diagram of a cross section of a planar transformer of a third embodiment.

FIG. 4B is a cross-sectional view of the planar transformer 10 of the third embodiment.

The coil substrate 20 forming the planar transformer 10 of the third embodiment is formed of 14 portions (PC).

The fifth portion (PC5) and the sixth portion (PC6) are the primary coil parts (PCW1). Each of the primary coil parts (PCW1) has a primary coil (C1) on the first surface (F) thereof. Each of the primary coil parts (PCW1) does not have a primary coil (C1) on the second surface (S) thereof. The seventh to fourteenth portions (PC) are the secondary coil parts (PCW2). Each of the secondary coil parts (PCW2) has a secondary coil (C2) on each of both sides of the flexible substrate 22. The first to fourth portions (PC) are coilless parts (PCO). Two coilless parts (PCO) are sandwiched between one primary coil part (PCW1) and one secondary coil part (PCW2). Two coilless parts (PCO) are sandwiched between two secondary coil parts (PCW2).

Fourth Embodiment

Figure 8A:
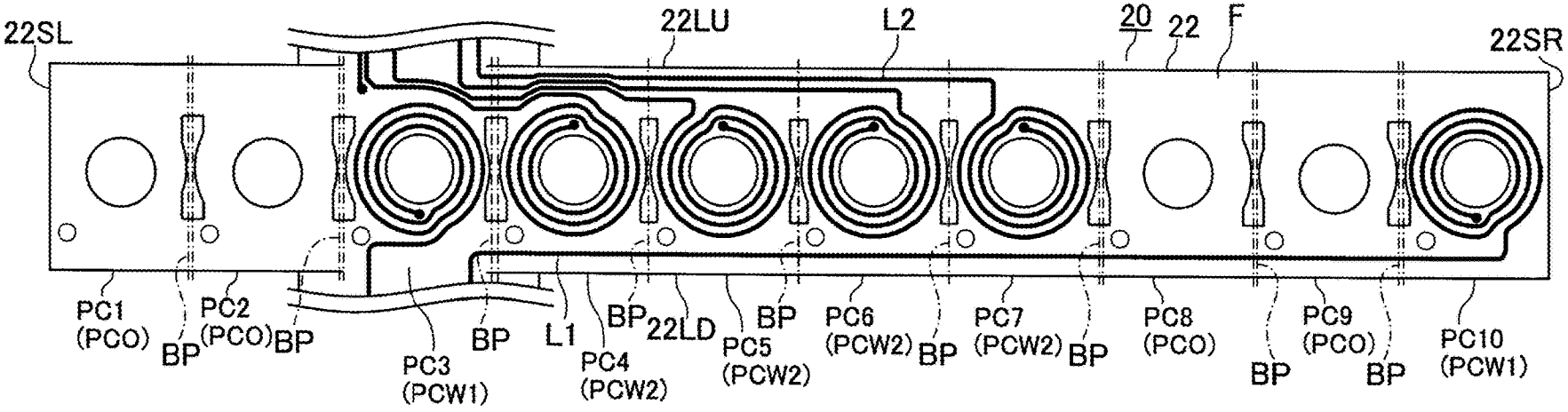
FIG. 8A illustrates a first surface of a coil substrate for manufacturing a planar transformer according to a fourth embodiment.
Figure 8B:
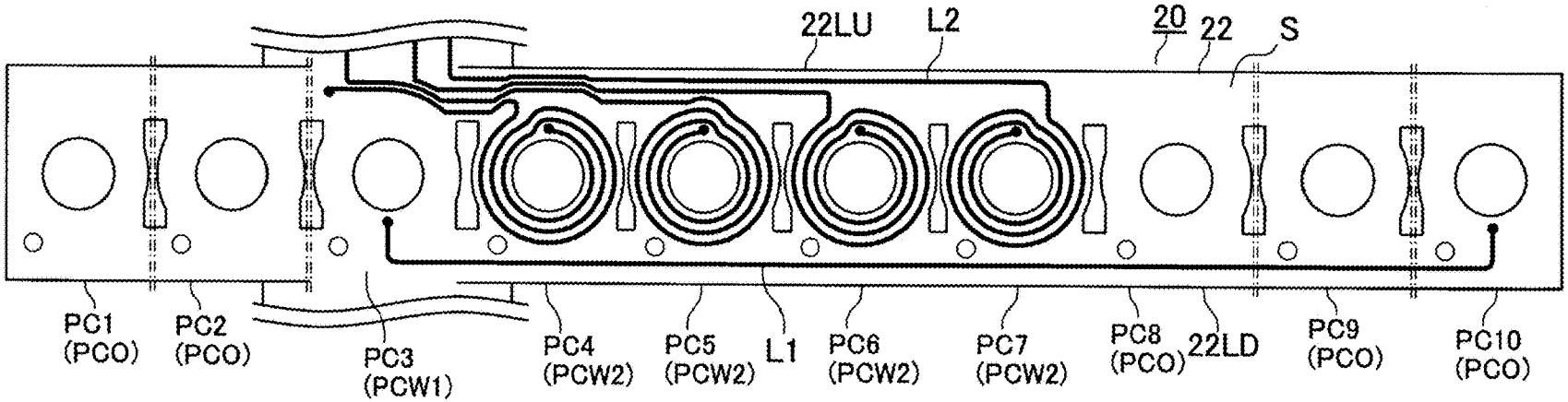
FIG. 8B illustrates a second surface of the coil substrate for manufacturing the planar transformer of the fourth embodiment.

FIGS. 8A and 8B illustrate the coil substrate 20 for forming the planar transformer of the fourth embodiment. In FIGS. 8A and 8B, the terminal substrates (22EU, 22ED) are omitted. FIG. 8A illustrates the first surface (F) of the coil substrate 20. FIG. 8B illustrates the second surface (S) of the coil substrate 20. The coils (C) and the conductor patterns (DC) on the second surface (S) are observed from a position above the first surface (F). The coil substrate 20 is formed of 10 portions (PC). The first, second, eighth and ninth portions (PC) are coilless parts (PCO). The third to seventh and tenth (N-th) portions (PC) are coil parts (PCW). The third portion (PC3) and the tenth portion (PC10) are primary coil parts (PCW1). The fourth to seventh portions (PC) are secondary coil parts (PCW2). Each of the secondary coil parts (PCW2) has a coil (C) on each of both sides of the flexible substrate 22. Each of the primary coil parts (PCW1) has a coil (C) on the first surface (F) thereof.

The first portion (PC1) and the second portion (PC2) are sandwiched between the third portion (PC3) and the tenth portion (PC10).

The eighth portion (PC8) and the ninth portion (PC9) are sandwiched between the sixth portion (PC6) and the seventh portion (PC7).

In the planar transformer 10 of the fourth embodiment, coilless parts (PCO) are sandwiched between the two primary coil parts (PCW1). Further, coilless parts (PCO) are sandwiched between two secondary coil parts (PCW2). Further, the first surface (F) and the second surface (S) of each of the coilless parts (PCO) are completely exposed.

In the fourth embodiment, coilless parts (PCO) exist between two secondary coil parts (PCW2). Therefore, even when a large voltage is generated between the secondary coil in the sixth portion (PC6) and the secondary coil in the seventh portion (PC7), insulation resistance between the secondary coil in the sixth portion (PC6) and the secondary coil in the seventh portion (PC7) can be ensured.

It is also possible that the number of the coilless parts (PCO) sandwiched between two coil parts (PCW) is 3 or more.

According to Japanese Patent Application Laid-Open Publication No. 2000-340445, multiple green tapes are prepared. Therefore, it is thought that it is difficult to manufacture a planar transformer with a high yield. According to Japanese Patent Application Laid-Open Publication No. 2000-340445, multiple green tapes are stacked. Therefore, it is expected that it is difficult to manufacture a planar transformer having high positional accuracy.

A planar transformer according to an embodiment of the present invention is formed by folding a coil substrate that includes a flexible substrate and multiple coils, the flexible substrate having a first surface and a second surface on an opposite side with respect to the first surface, and the multiple coils being formed on the flexible substrate. Then, the coils include a primary coil and a secondary coil; the coil substrate is formed of portions (coil parts) that have the coils and portions (coilless parts) that do not have the coils; and the folding includes sandwiching at least one coilless part between two coil parts.

According to an embodiment of the present invention, the planar transformer is formed by folding the coil substrate having the primary coil and the secondary coil. The coil substrate is formed of the one flexible substrate. That is, the planar transformer is formed by folding the one flexible substrate. According to the embodiment, it is not necessary to prepare multiple insulating layers. Further, it is not necessary to sequentially stack insulating layers and coils. Therefore, according to the embodiment, the manufacturing time can be shortened. The manufacturing cost can be reduced. By folding the flexible substrate, the coils are stacked in an up-down direction. Therefore, positional accuracy between a coil positioned at a higher position and a coil positioned at a lower position can be increased. Interference between a coil positioned at a higher position and a coil positioned at a lower position can be increased. A planar transformer having high performance can be provided.

The flexible substrate that forms the planar transformer is sandwiched between the primary coil and the secondary coil. An insulation interval between the primary coil and the secondary coil can be ensured. Insulation reliability between the primary coil and the secondary coil can be increased. Positional accuracy between the primary coil and the secondary coil can be increased. The manufacturing cost can be reduced.

Obviously, numerous modifications and variations of the present invention are possible in light of the above teachings. It is therefore to be understood that within the scope of the appended claims, the invention may be practiced otherwise than as specifically described herein.

What is claimed is:

1. A planar transformer, comprising:

a coil substrate comprising a flexible substrate and a plurality of coils formed on the flexible substrate, wherein the coil substrate is formed to have a plurality of coil parts and a plurality of coilless parts such that the coil parts have the coils and that the coilless parts do not have the coils, and the coil substrate is folded such that at least one of the coilless parts is sandwiched between two of the coil parts, the plurality of coil parts and the plurality of coilless parts are formed between a first end of the flexible substrate and a second end of the flexible substrate on an opposite side with respect to the first end such that the coil parts and the coilless parts form a row, and the coilless part sandwiched between the two of the coil parts includes the first end of the flexible substrate.

2. The planar transformer according to claim 1, wherein the plurality of coils includes a plurality of primary coils and a plurality of secondary coils and is formed on the flexible substrate such that the primary coils are stacked on the secondary coils respectively and that the two of the coil parts sandwiching the at least one of the coilless parts are a primary coil part including one of the primary coils and a secondary coil part including one of the secondary coils.

3. The planar transformer according to claim 1, wherein the flexible substrate comprises a single-piece flexible substrate.

4. The planar transformer according to claim 2, wherein the coil substrate is folded such that two or more of the coilless parts are sandwiched between the primary coil part and one of the secondary coil part.

5. The planar transformer according to claim 1, wherein the flexible substrate has a first surface and a second surface on an opposite side with respect to the first surface, and the at least one coilless part sandwiched between the two of the coil parts is formed such that the first and second surfaces of the flexible substrate between coils formed in the two of the coil parts are exposed.

6. The planar transformer according to claim 1, wherein the flexible substrate has a first surface and a second surface on an opposite side with respect to the first surface, and the first and second surfaces of the flexible substrate in the at least one coilless part sandwiched between the two of the coil parts are exposed.

7. The planar transformer according to claim 1, wherein the coilless part including the first end is a first coilless part of the plurality of coilless parts, the primary coil part is formed next to the first coilless part, the secondary coil part is formed next to the primary coil part, and the coil substrate is folded such that the coil substrate is folded between the first coilless part and the primary coil part and between the primary coil part and the secondary coil part.

8. The planar transformer according to claim 1, wherein the coilless part including the first end of the flexible substrate is a first coilless part of the plurality of coilless parts, and a second coilless part of the plurality of coilless parts is formed next to the first coilless part.

9. The planar transformer according to claim 8, wherein the primary coil part is formed next to the second coilless part, and the secondary coil part is formed next to the primary coil part.

10. The planar transformer according to claim 9, wherein the flexible substrate is folded such that the flexible substrate is folded between the first coilless part and the second coilless part, between the second coilless part and the primary coil part, and between the primary coil part and the secondary coil part, and that the first coilless part and the second coilless part is sandwiched between the primary coil part and the secondary coil part.

11. The planar transformer according to claim 2, further comprising:

a plurality of input terminals;

a plurality of output terminals;

a plurality of input lines connecting the primary coils to the input terminals; and a plurality of output lines connecting the secondary coils to the output terminals, wherein the flexible substrate has a first end, a second end on an opposite side with respect to the first end, an upper side between the first end and the second end, and a lower side on an opposite side with respect to the upper side, the plurality of coil parts and the plurality of coilless parts are formed between the first end and the second end such that the coil parts and the coilless parts form a row, the plurality of input lines is formed along the lower side, and the plurality of output lines is formed along the upper side.

12. The planar transformer according to claim 11, wherein the plurality of input lines is formed between the lower side and the plurality of coils, and the plurality of output lines is formed between the upper side and the plurality of coils.

13. The planar transformer according to claim 1, wherein the plurality of coil parts and the plurality of coilless parts are formed such that a width of each of the coil parts is substantially equal to a width of each of the coilless parts.

14. The planar transformer according to claim 1, wherein the coil substrate is folded such that two or more of the coilless parts are sandwiched between the two of the coil parts.

15. The planar transformer according to claim 1, further comprising:

a plurality of input terminals;

a plurality of output terminals;

a plurality of input lines connecting the coils to the input terminals; and a plurality of output lines connecting the coils to the output terminals, wherein the flexible substrate has a first end, a second end on an opposite side with respect to the first end, an upper side between the first end and the second end, and a lower side on an opposite side with respect to the upper side, the plurality of coil parts and the plurality of coilless parts are formed between the first end and the second end such that the coil parts and the coilless parts form a row, the plurality of input lines is formed along the lower side, and the plurality of output lines is formed along the upper side.

16. The planar transformer according to claim 15, wherein the plurality of input lines is formed between the lower side and the plurality of coils, and the plurality of output lines is formed between the upper side and the plurality of coils.

17. The planar transformer according to claim 2, wherein the plurality of coil parts and the plurality of coilless parts are formed such that a width of each of the coil parts is substantially equal to a width of each of the coilless parts.

18. The planar transformer according to claim 3, wherein the plurality of coil parts and the plurality of coilless parts are formed such that a width of each of the coil parts is substantially equal to a width of each of the coilless parts.

19. The planar transformer according to claim 2, wherein the flexible substrate comprises a single-piece flexible substrate.

20. The planar transformer according to claim 4, wherein the plurality of coil parts and the plurality of coilless parts are formed such that a width of each of the coil parts is substantially equal to a width of each of the coilless parts.

* * * * *